US008121776B2

(12) United States Patent
Hiruta et al.

(10) Patent No.: US 8,121,776 B2
(45) Date of Patent: Feb. 21, 2012

(54) INCIDENT RESOLUTION JUDGMENT SYSTEM

(75) Inventors: Tomoaki Hiruta, Hitachi (JP); Masatoshi Kumagai, Hitachi (JP); Takayoshi Yokota, Hitachiohta (JP); Koichiro Tanikoshi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 1014 days.

(21) Appl. No.: 11/945,695

(22) Filed: Nov. 27, 2007

(65) Prior Publication Data

US 2008/0140303 A1 Jun. 12, 2008

(30) Foreign Application Priority Data

Nov. 28, 2006 (JP) ..... 2006-319452

(51) Int. Cl.
*G08G 1/00* (2006.01)
*G08G 1/048* (2006.01)

(52) U.S. Cl. ..... 701/117; 701/118; 701/119; 701/200; 701/201; 701/202; 701/204; 701/208; 701/210; 701/213

(58) Field of Classification Search ..... 701/200–224
See application file for complete search history.

(56) References Cited

U.S. PATENT DOCUMENTS

| | | | | |
|---|---|---|---|---|
| 5,173,691 | A * | 12/1992 | Sumner | 340/905 |
| 5,182,555 | A | 1/1993 | Sumner | |
| 5,311,197 | A * | 5/1994 | Sorden et al. | 342/457 |
| 5,847,663 | A * | 12/1998 | Chasek | 340/905 |
| 6,012,012 | A * | 1/2000 | Fleck et al. | 701/117 |
| 6,943,702 | B2 | 9/2005 | Kato | |
| 7,323,969 | B1 * | 1/2008 | Delgado et al. | 340/425.5 |
| 2001/0020891 | A1 * | 9/2001 | Minagawa et al. | 340/5.61 |
| 2001/0051853 | A1 * | 12/2001 | Evans | 701/301 |
| 2002/0038182 | A1 * | 3/2002 | Wong et al. | 701/213 |

FOREIGN PATENT DOCUMENTS

| | | | |
|---|---|---|---|
| DE | 102 52 768 | A1 | 6/2004 |
| JP | 2003-284110 | | 10/2003 |
| JP | 2005-165388 | | 6/2005 |
| JP | 2005-242552 | | 9/2005 |
| JP | 2005-285108 | A | 10/2005 |
| JP | 2006-313519 | | 11/2006 |

OTHER PUBLICATIONS

European Search Report dated Mar. 10, 2010 (Four (4) pages).
Office Action received in Japanese Patent Application No. 2006-319452 dated Jan. 24, 2011.

* cited by examiner

*Primary Examiner* — Khoi Tran
*Assistant Examiner* — Bhavesh V Amin
(74) *Attorney, Agent, or Firm* — Crowell & Moring LLP

(57) ABSTRACT

An incident resolution judgment system and method are provided which reduce processing load on a traffic information center included in an incident detection system. When an incident occurs, the traffic information center generates an incident resolution judgment condition, which is used by each vehicle to judge whether the incident is resolved, and transmits the generated incident resolution judgment condition to each vehicle. Each vehicle judges in accordance with its travel history information and the received incident resolution judgment condition whether the incident is resolved. When the incident is judged to be resolved, each vehicle notifies the traffic information center that the incident is resolved. In accordance with incident resolution detection results produced by a plurality of vehicles, the traffic information center forms a final judgment to indicate that the incident is actually resolved and notifies each vehicle of incident resolution.

7 Claims, 14 Drawing Sheets

FIG. 4

| INCIDENT INFORMATION TABLE | |
|---|---|
| POSITIONAL INFORMATION | LATITUDE |
| | LONGITUDE |
| | LINK NUMBER |
| | POSITION ON LINK |
| TEMPORAL INFORMATION | |
| INCIDENT TYPE | |
| AVERAGE VELOCITY INFORMATION | NUMBER m OF VEHICLES |
| | VHECLE 1 AVERAGE VELOCITY PREVAILING BEFORE INCIDENT PASSAGE |
| | VHECLE 1 AVERAGE VELOCITY PREVAILING AFTER INCIDENT PASSAGE |
| | VHECLE 2 AVERAGE VELOCITY PREVAILING BEFORE INCIDENT PASSAGE |
| | VHECLE 2 AVERAGE VELOCITY PREVAILING AFTER INCIDENT PASSAGE |
| | : |
| | VHECLE m AVERAGE VELOCITY PREVAILING BEFORE INCIDENT PASSAGE |
| | VHECLE m AVERAGE VELOCITY PREVAILING AFTER INCIDENT PASSAGE |
| TRAVEL PATH INFORMATION ABOUT PASSAGE | NUMBER m OF VEHICLES |
| | NUMBER m OF SAMPLES |
| | INCIDENT PASSAGE PATH a1(1) of VEHICLE 1 |
| | a1(2) |
| | : |
| | a1(n) |
| | INCIDENT PASSAGE PATH a2(1) of VEHICLE 2 |
| | a2(2) |
| | : |
| | a2(n) |

FIG. 5

| INCIDENT RESOLUTION CONDITION INFORMATION TABLE | |
|---|---|
| POSITIONAL INFORMATION | LATITUDE |
| | LONGITUDE |
| | LINK NUMBER |
| | POSITION ON LINK |
| VELOCITY INFORMATION | AVERAGE VELOCITY DIFFERENCE THRESHOLD VALUE |
| TYPICAL PATH CONDITIONS | NUMBER OF TYPICAL PATHS |
| | NUMBER OF SAMPLES |
| | THRESHOLD VALUE |
| | TYPICAL PATH x0(1) FOR INCIDENT PASSAGE |
| | x0(2) |
| | : |
| | x0(n) |
| | TYPICAL PATH y0(1) FOR INCIDENT PASSAGE |
| | y0(2) |
| | : |
| | y0(n) |
| | : |

| TYPICAL PATH CLASSIFICATIONS | | | |
|---|---|---|---|
| | BEFORE PASSAGE | AFTER PASSAGE | GROUP |
| a 1 | LANE 1 | LANE 1 | GROUP 1 |
| a 2 | LANE 1 | LANE 1 | |
| a 3 | LANE 1 | LANE 1 | |
| a 4 | LANE 1 | LANE 2 | GROUP 2 |
| a 5 | LANE 1 | LANE 2 | |

| | |
|---|---|
| TRAVEL PATH CONDITIONS | D |
| | Dmax |
| VELOCITY DIFFERENCE CONDITIONS | V_after-V_before |
| | Δv_min |

INCIDENT RESOLUTION JUDGMENT SYSTEM

BACKGROUND OF THE INVENTION

At present, a traffic information provision service supplies traffic jam information, incident/restriction information about such as accidents and lane restrictions, service area/parking area occupancy information, and various other traffic information. Car navigation devices calculate a route to a destination in accordance with the traffic jam information, and indicate a route bypassing congested roads, and accurately estimate the time of arrival at the destination, thereby improving convenience to the user. Further, the car navigation devices can display the information about the locations of accidents and faulty vehicles and the locations and periods of constructions and restrictions, which is included in the incident/restriction information, to convey relevant traffic information to the user and indicate a route bypassing the sites of incidents.

However, the update of incident/restriction information is delayed because the traffic information provision service manually inputs and sets information after receipt of the information about encountered/resolved accidents. Therefore, the navigation devices cannot select a road running through the site of an incident as a route even when the incident is actually resolved.

JP-A-2005-285108 disclose a system that detects an obstacle on a road by using travel path data collected from vehicles and provides detection results to the vehicles as obstacle information. This system can detect an accident, restriction, or other contingency (hereinafter referred to as an incident) from the travel path data to obtain accurate information about not only an obstacle but also the occurrence and resolution date/time and the location of an incident.

SUMMARY OF THE INVENTION

The present invention relates to a system that estimates whether a detected accident, restriction, or other incident is resolved, in accordance with probe car information.

In an incident detection method disclosed by JP-A-2005-285108, a center detects obstacles and judges whether the obstacles are cleared. Therefore, the detection processing load on the center increases with an increase in the number of vehicles that transmit the travel path data. Particularly, in order to judge without delay whether a detected obstacle is removed after detection of obstacles, it is necessary to frequently acquire the travel path data from each vehicle. Accordingly, a center system is demanded to be capable of performing an obstacle detection process on a large amount of frequently acquired travel path data within a predetermined period, and the operating cost of the center increases.

In view of the above problems with the prior art, an object of the present invention is to provide an incident resolution detection system that reduces the processing load of detecting the resolution of an encountered incident.

To achieve the above object, the present invention causes the center to set an incident resolution judgment condition for an incident and to supply the defined incident resolution judgment condition to vehicles, and causes the vehicles to detect whether the incident is resolved, in accordance with the received incident resolution judgment condition, and to convey incident resolution detection results to the center, and causes the center to finally judge whether the incident is resolved, in accordance with the incident resolution detection results received from the vehicles, and to update incident information.

In a situation where the resolution of an incident is judged as described above, if an on-road obstacle is detected, for example, at a certain site on a road link, the center provides each vehicle with resolution judgment condition for the on-road obstacle that includes such as the position of the obstacle (the road link at which the obstacle exists), a travel path pattern for avoiding the obstacle, traveling velocity, and the number of breakings and stops in accordance with the type of incident (on-road obstacle). Each vehicle compares the received parameters against its own traveling status to judge whether the on-road obstacle still exists or is removed. When the vehicle judges that the on-road obstacle is removed, the vehicle notifies the center that the on-road obstacle is resolved. The center judge that the on-road obstacle is actually resolved when information reliability is confirmed depending on the number of on-road obstacle resolution notifications, and update the incident information. Thus, the center does not need to perform calculation process of detecting the resolution of the incident in each of travel path data sent from a plurality of vehicles. It is therefore possible to reduce the incident resolution judgment processing load on the center.

According to the present invention, the center provides each vehicle with the incident resolution judgment condition. Each vehicle compares the incident resolution judgment condition against its traveling status to judge whether an incident is resolved, and conveys the judgment result to the center. The center forms a final judgment to indicate whether the incident is resolved, in accordance with the number of incident resolution notifications sent from a plurality of vehicles. Accordingly, it is possible to reduce the incident resolution judgment processing load on the center.

BRIEF DESCRIPTION OF THE DRAWINGS

FIG. 4 is a diagram showing the configuration of an incident information table.

FIG. 5 is a diagram showing the configuration of an incident resolution condition information table.

DETAILED DESCRIPTION OF THE PREFERRED EMBODIMENTS

A method of creating incident resolution judgment conditions from incident information and allowing a probe car to judge whether an incident is resolved will now be described.

First Embodiment

Figure 1:
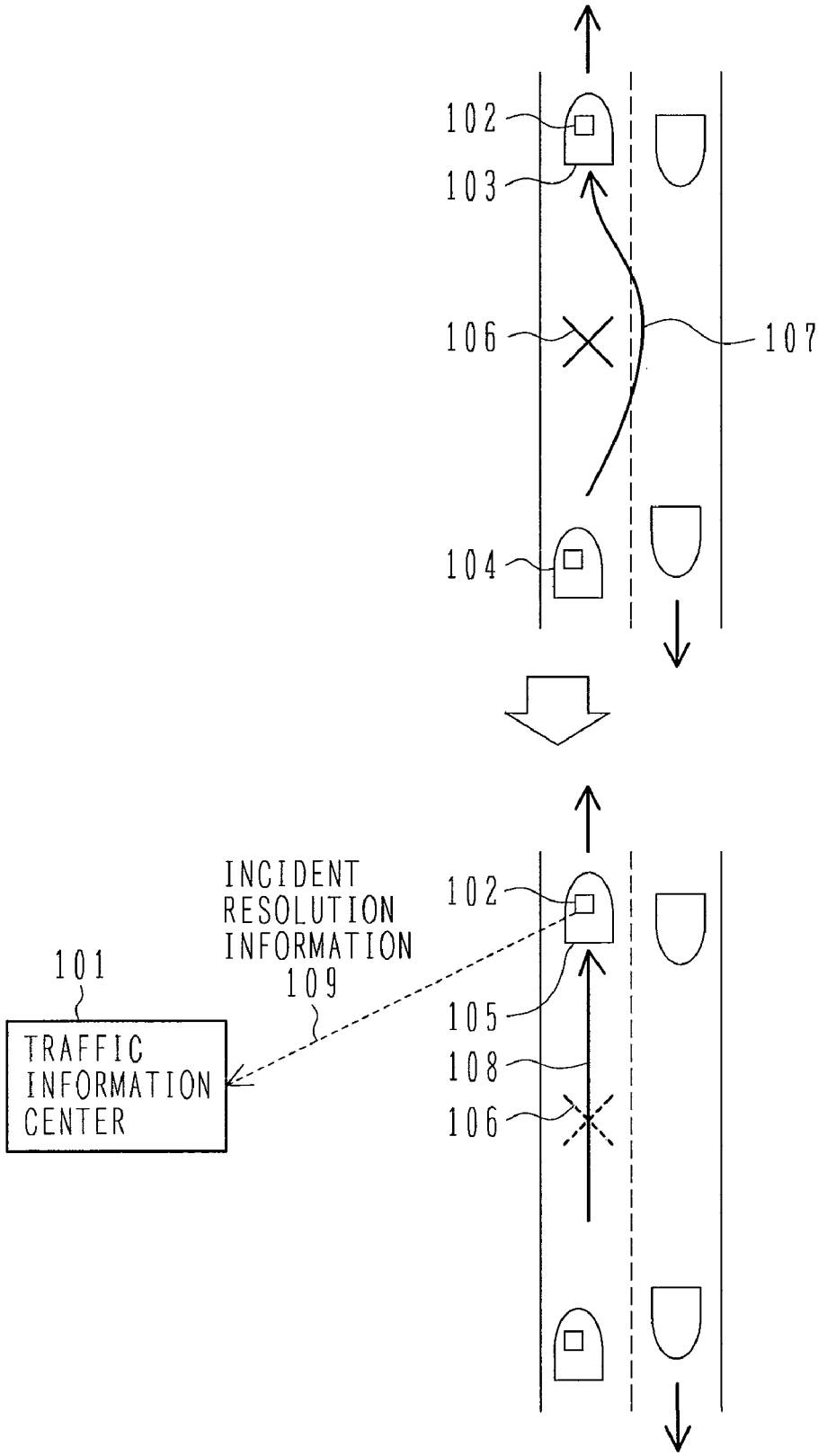
FIG. 1 is a diagram illustrating how vehicles pass an incident site.

FIG. 1 shows a traffic information center 101 and vehicles 103-105 in which an in-vehicle device 102 is mounted. As indicated in FIG. 1, the vehicles 103-105 pass an incident site 106 on a road of single-sided one lane (a two lane load). To avoid an incident, the vehicle 103 passes the incident site 106 in a manner indicated by travel path 107. After the vehicle 103 passes the incident site 106, the in-vehicle device 102 mounted in the vehicle 103 does not transmit incident resolution information 109 to the traffic information center 101 because incident resolution conditions received from the traffic information center 101 are not satisfied.

When the incident is subsequently resolved, the vehicle 105 passes the incident site 106 in a manner indicated by travel path 108. When the incident resolution conditions received from the traffic information center 101 is satisfied after the vehicle 105 passes the incident site, the in-vehicle device 102 mounted in the vehicle 105 transmits the incident resolution information 109 to the traffic information center 101.

Figure 2:
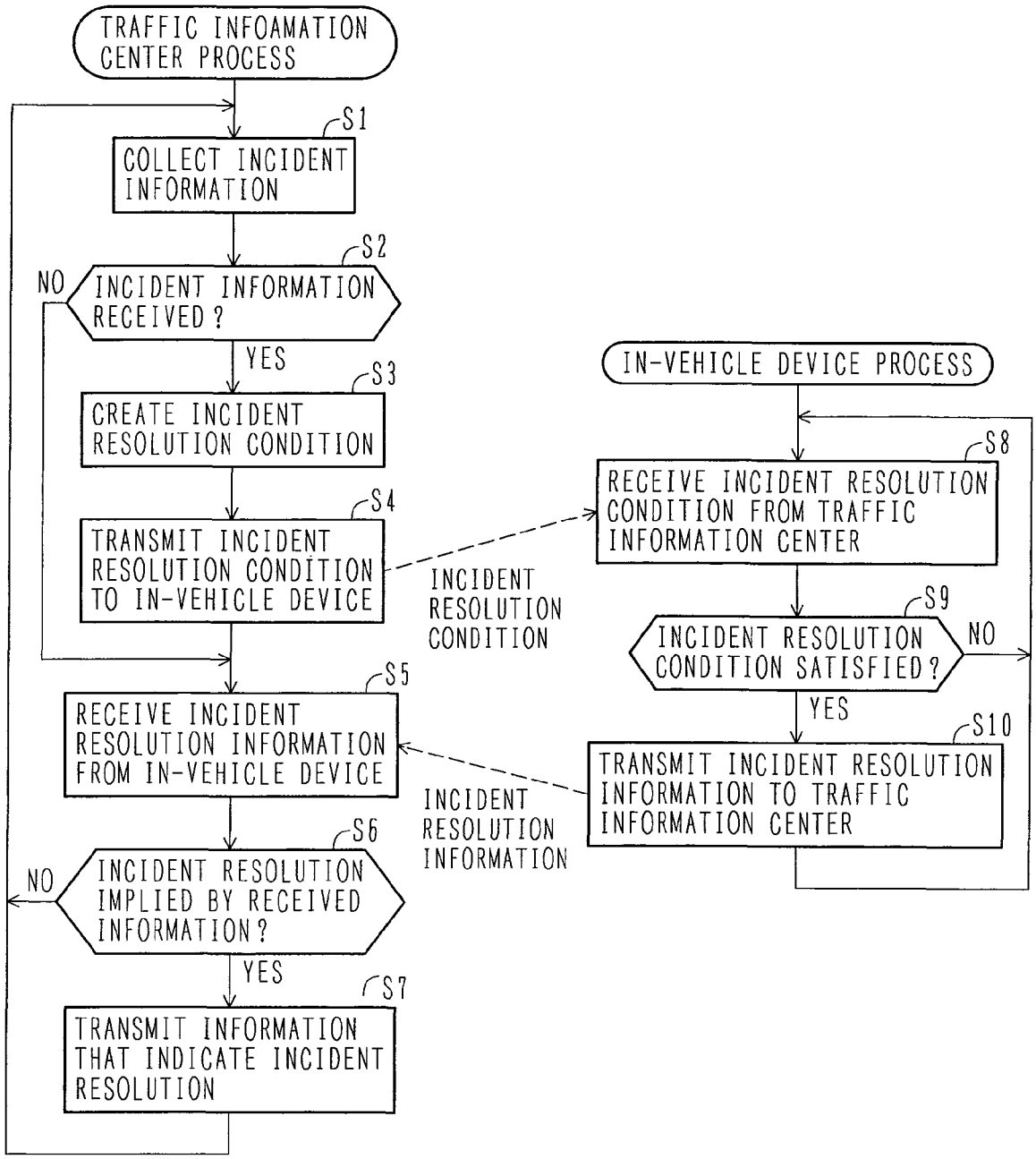
FIG. 2 is a flowchart illustrating a process performed by an incident resolution judgment system.
Figure 3:
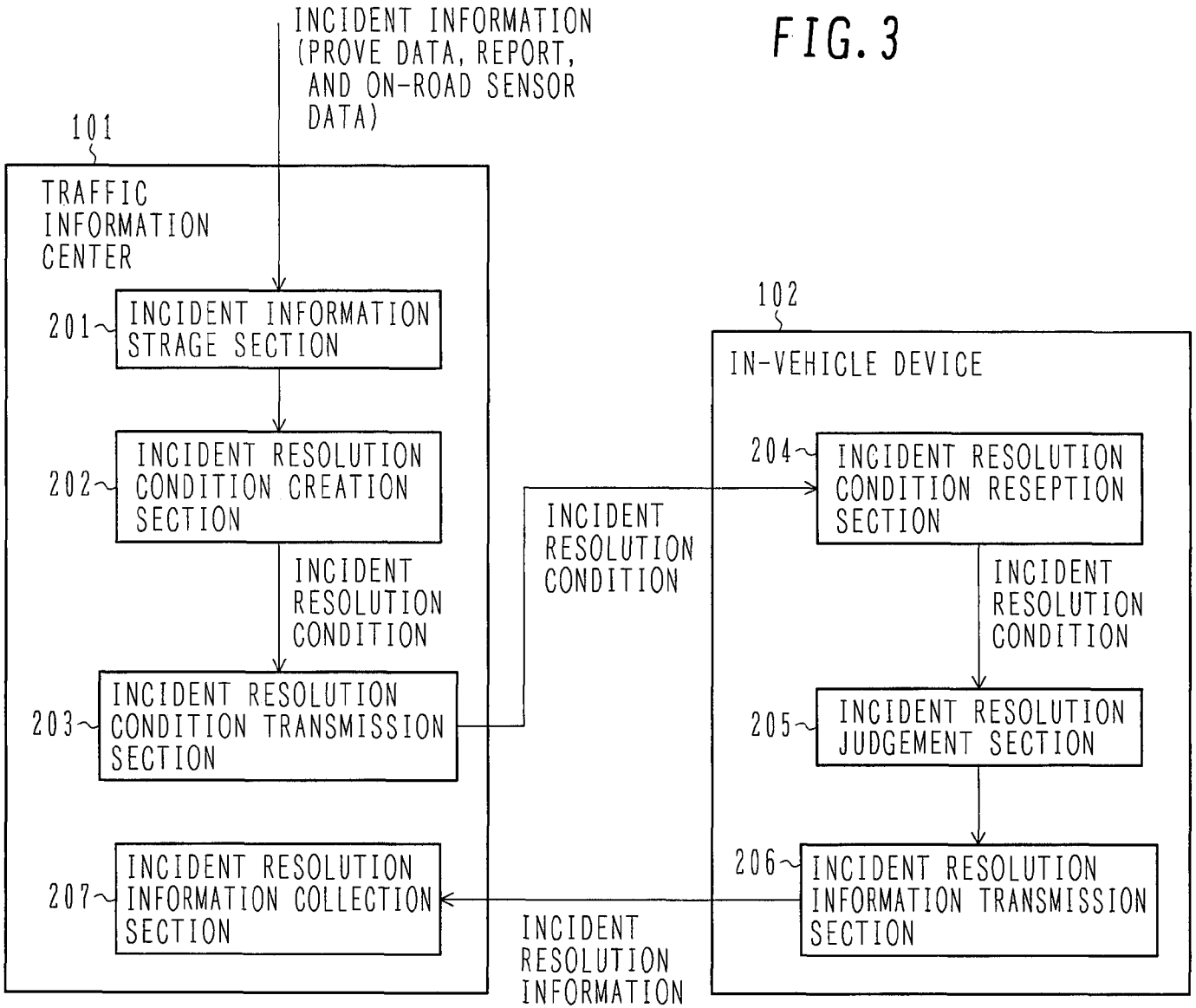
FIG. 3 is a diagram illustrating how the incident resolution judgment system is configured.

The present embodiment will now be described with reference to a flowchart in FIG. 2. FIG. 3 shows the configuration of a traffic information system for a probe car according to the present invention. The traffic information system includes the traffic information center 101 and in-vehicle device 102. An optical beacon, wireless LAN, cellular phone, DSRC device, or other communication means (not shown) is used to establish bidirectional communication between the traffic information center 101 and in-vehicle device 102. Further, FM broadcast means, digital terrestrial broadcast means, or other broadcast means is used to transmit information from the traffic information center 101 to the in-vehicle device 102.

The traffic information center 101 includes an incident information storage section 201, an incident resolution condition creation section 202, an incident resolution condition transmission section 203, and an incident resolution information collection section 207. The in-vehicle device 102 includes an incident resolution condition reception section 204, an incident resolution judgment section 205, and an incident resolution information transmission section 206.

The traffic information center 101 causes the incident information storage section 201 to collect the information about an incident targeted for resolution judgment (step S1). The collected incident information is stored, for example, on a hard disk drive. The collected incident information includes the information about the location of an incident, incident occurrence time, the type of the incident (accident, construction, etc.), the average vehicle velocity prevailing before and after incident site passage, and a travel path, and is stored in an incident information table shown in FIG. 4. The incident information table stores the positional information about the location of a detected incident that includes latitude, longitude, the link number of a road link at which the incident occurred, and the position of the incident on the link. The incident information table further stores temporal information about the incident and the type of the incident. The incident information table further stores the travel path information about probe car passage through each incident site, which is stored on an individual probe car basis, and the information about average probe car velocity prevailing before and after the incident site. The average velocity information includes the number of probe cars that collected the average velocity information and the average velocity of probe cars that passed a point after and a point before the incident site. The travel path information about passage includes the number of probe cars that collected travel path information, the number of samples taken when a travel path of each vehicle passing through the incident site is expressed as a sequence of points, and the information about the individual points in the sequence of points. The travel path information about passage and the average velocity information are included in travel history information that is transmitted to the traffic information center 101 from the in-vehicle device in a probe car via the communication means at the time of incident site passage.

When incident information is collected anew, the flow proceeds to step S3. If not, the flow proceeds to step S5.

The incident resolution condition creation section 202 uses the incident information sent from the incident information storage section 201 to create incident resolution conditions and registers the created incident resolution conditions in an incident resolution condition information table shown in FIG. 5 (step S3). The incident resolution conditions include positional information about the location of a target incident, reference data for incident resolution judgment, and threshold value therefor. The reference data for incident resolution judgment includes typical path conditions concerning a typical travel path for incident site passage and velocity information, which indicates the average velocity prevailing before and after an incident site. The typical path conditions include the number of typical paths that are used as an incident resolution condition, the number of samples taken when a typical path is expressed as a sequence of points, a threshold value for a typical path, and the point sequence information about each typical path prevailing at the time of incident site passage.

A method of creating a typical path that is a typical travel path for a vehicle passing an incident site will now be described. The typical travel path for a vehicle passing the incident site is created in accordance with an average value of travel path information about a plurality of vehicles, which is recorded in the table shown in FIG. 4 as the travel path information concerning incident site passage.

Figure 6:
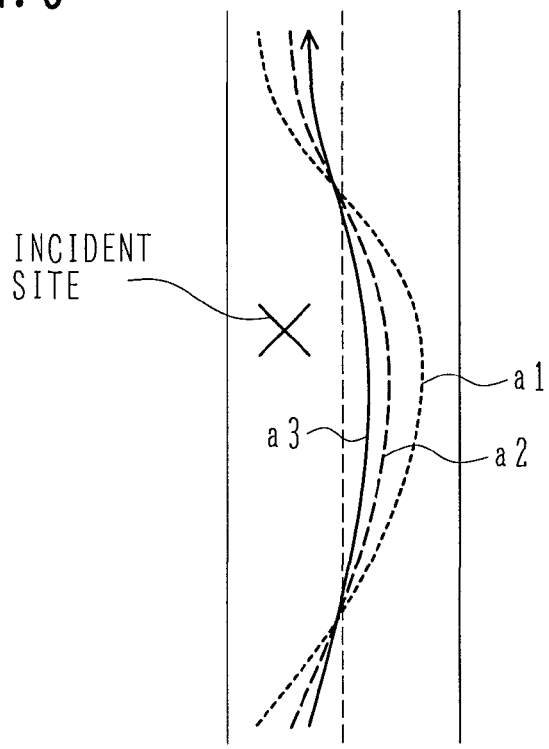
FIG. 6 is a diagram illustrating travel paths of vehicles that pass an incident site on a road of single-sided one lane (a two lane load).

FIG. 6 shows travel paths a1-a3 of a plurality of vehicles that passed an incident site on a road of single-sided one lane immediately after the occurrence of an incident. It is assumed that a data string obtained when the travel paths a1-am of m vehicles are sampled at n points over a fixed distance is a1(1) . . . a1($n$) to am(1) . . . am(n). In this instance, a typical path x0($n$) is calculated as indicated below.

$$x0(i)=(a1(i)+\ldots+am(i))/m \quad (i=1\ldots n) \qquad \text{(Equation 1)}$$

Figure 7:
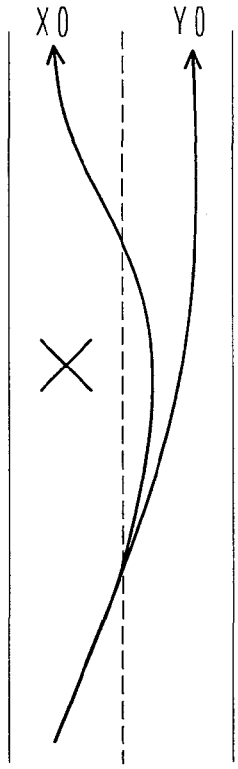
FIG. 7 is a diagram illustrating travel paths of vehicles that run on a road of single-sided multiple lanes.
Figure 8:
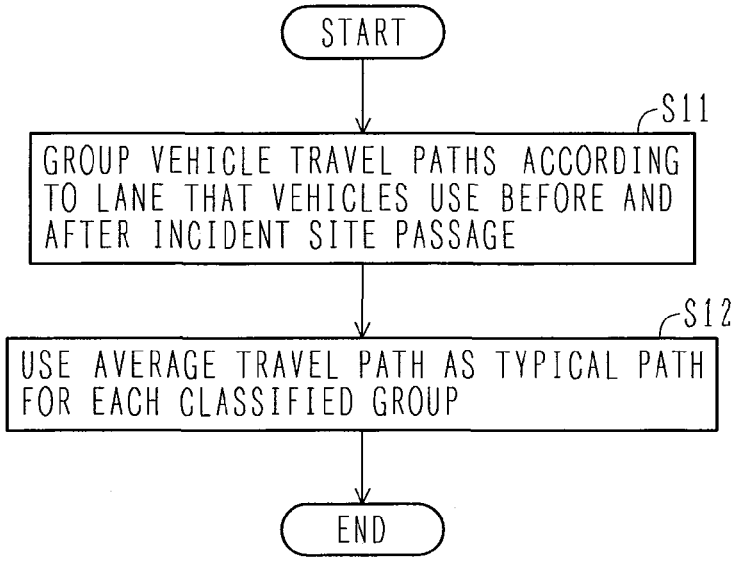
FIG. 8 is a flowchart illustrating a process of creating a plurality of typical paths.
Figure 9:
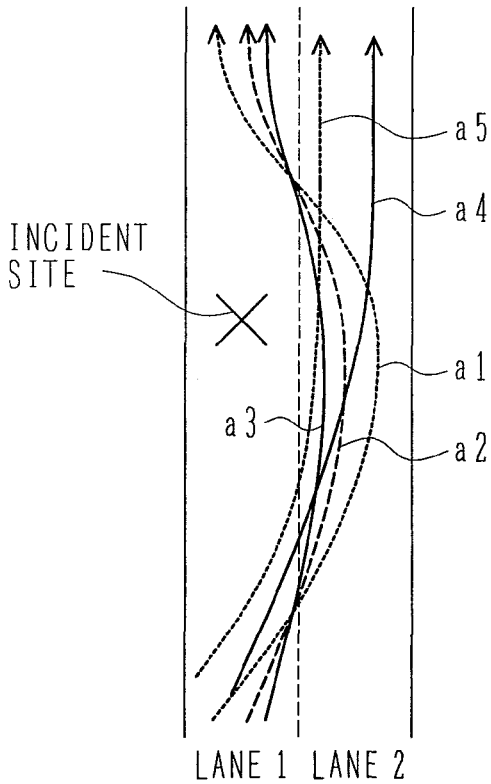
FIG. 9 is a diagram illustrating another example of creating a plurality of typical paths.
Figure 10:
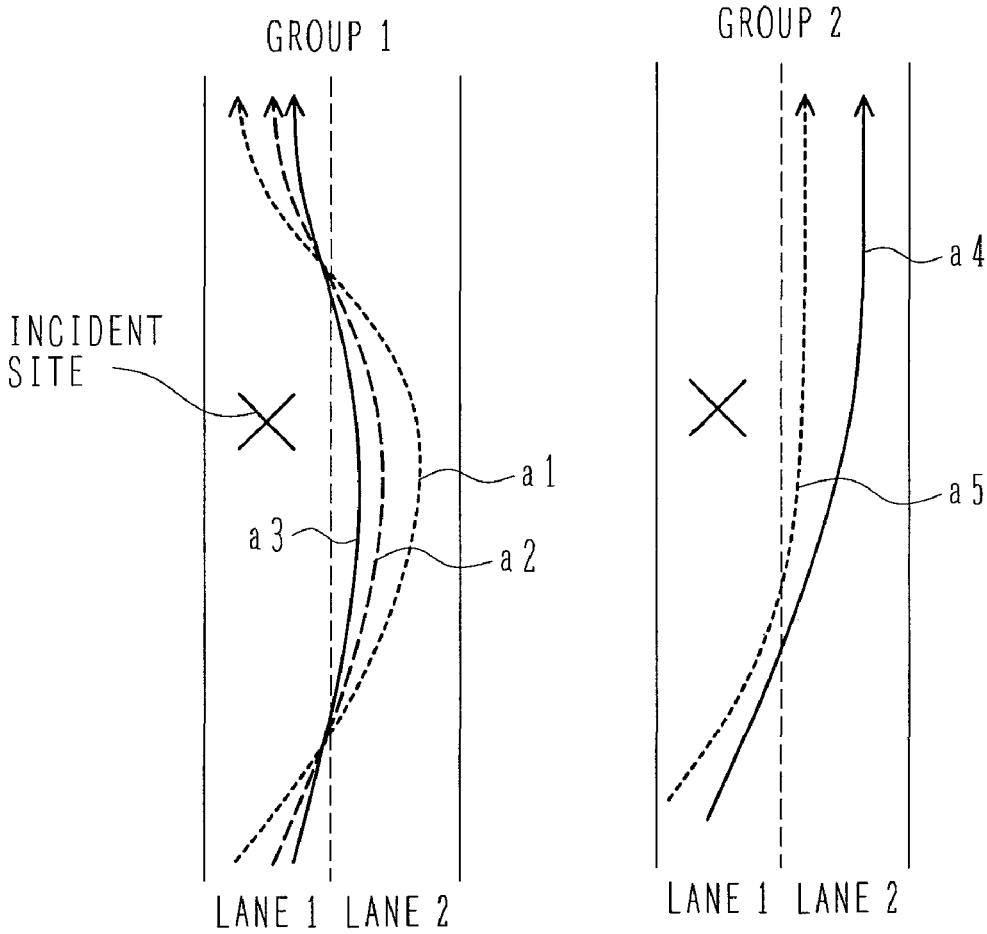
FIG. 10 is a diagram illustrates how travel paths are classified.
Figure 11:
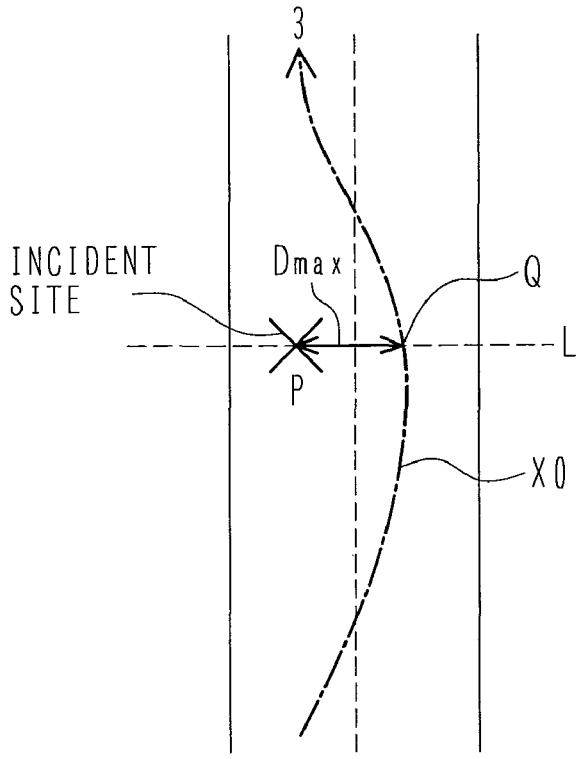
FIG. 11 is a diagram illustrating the distance between an incident site and a typical path.

For a road having two or more lanes on single side, a plurality of typical travel paths, such as x0 and y0 in FIG. 7, are conceived. Travel path x0 is the travel path of a vehicle that avoided an incident, returned to the original lane, and continued running. Travel path y0 is the travel path of a vehicle that switched to an adjacent lane to avoid the incident and continued running in that lane. A flowchart in FIG. 8 is followed to create a plurality of typical paths. A method of creating a plurality of typical paths from travel paths a1-a5 shown in FIG. 9 will now be described as an example. The travel paths are classified according to the lane that vehicles use before and after incident site passage (step S11). For a road of single-sided multiple lanes, the travel paths can be classified into group 1 and group 2 depending on whether a vehicle returned to the original lane. Group 1 represents the travel path of a vehicle that ran in lane 1 before incident site passage, switched to lane 2 to avoid the incident site, and returned to lane 1 after incident site passage. Group 2 represents the travel path of a vehicle that ran in lane 1 before incident site passage, switched to lane 2 to avoid the incident site, and continued running in lane 2 after incident site passage. The travel paths of the classified groups are sampled over a fixed distance in the same manner as indicated in Equation 1 and averaged (step S12). Typical paths x0 and y0 are then created. In the example shown in FIGS. 9 and 10, travel path x0 is an average travel path of travel paths a1 to a3, which belong to group 1, whereas travel path y0 is an average travel path of travel paths a4 and a5, which belong to group 2.

A method of creating a threshold value for resolution judgment will now be described. The threshold value Dmax for a typical path is the distance PQ between an incident site P and an intersection Q. The intersection Q is a point at the intersection of a straight line L and typical path x0 when the straight line L is drawn from the incident site P in a direction perpendicular to the direction of a road. When there is a plurality of typical paths, the minimum distances PQ for the typical paths is regarded as the threshold value Dmax.

If the distances between the incident site P and the intersections of the straight line L and travel paths a1-am stored in the table shown in FIG. 4 are d1 to dm, the minimum distance may be used as the threshold value Dmax as indicated in Equation 2.

$$Dmax=\min(di)\ (i=1\ldots m) \quad \text{(Equation 2)}$$

Alternatively, the width of one lane may be set as the threshold value on the assumption that a vehicle can avoid the incident site by moving over a lateral distance substantially equal to the width of one lane.

Figure 12:
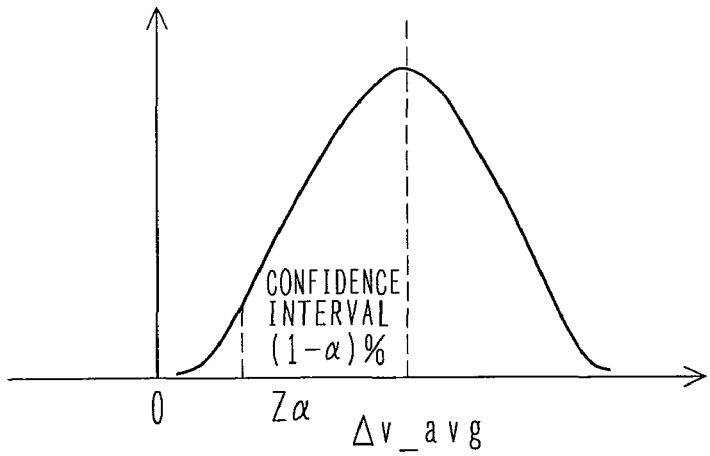
FIG. 12 is a diagram showing a threshold value that prevails when a distribution of average velocity difference of vehicles follows a normal distribution.

A method of creating a judgment condition by using an average velocity prevailing before and after an incident site will now be described. When the resolution of an incident is to be judged in accordance with an average velocity prevailing before and after the incident site, a threshold value Δv_min for a velocity difference is used. This average velocity difference threshold value Δv_min is determined from the average velocities of a plurality of vehicles that prevail before and after the incident site and are stored in the table shown in FIG. 4. It is assumed that the average velocity differences of m vehicles between a point before and a point after the incident site, which are determined from the average vehicle velocities stored in the table shown in FIG. 4, are Δv_1 to Δv_m, and that the average of them is Δv_avg. It is also assumed that the distribution of the average velocity differences follows a normal distribution based on the average value Δv_avg as shown in FIG. 12. Thus, a boundary of a confidence interval (1−α) % is regarded as the threshold value. Therefore, when the variance of the average velocity difference of m vehicles is σ, the velocity difference threshold value Δv_min is obtained as indicated below:

$$\Delta v_min=\Delta v_avg-Z\alpha\times\sigma/\sqrt{(m)} \quad \text{(Equation 3)}$$

If the velocity difference follows the normal distribution, the value Zα is 1.96 when the confidence interval is 95% or 2.576 when the confidence interval is 99%. However, it is assumed that Δv_min is 0 when it takes a negative value.

Alternatively, the minimum value may be selected from m average velocity difference samples and used as the velocity difference threshold value.

$$\Delta v_min=\min(\Delta v_i=1\ldots m) \quad \text{(Equation 4)}$$

The incident resolution condition transmission section 203 transmits the incident resolution condition created by the incident resolution condition creation section 202 to the in-vehicle device 102 of a probe car near the incident site via the communication means (step S3). For example, FM broadcast means, digital terrestrial broadcast means, wireless LAN, or DSRC device may be used as the communication means.

After transmitting the incident resolution condition to the probe car, the traffic information center 101 collects incident resolution information about the incident. Therefore, the incident resolution information collection section 207 collects the incident resolution information transmitted from the incident resolution information transmission section 206 of the in-vehicle device 102 (step S5). The traffic information center 101 collects the incident resolution information from a plurality of in-vehicle devices and eventually judges whether the incident is resolved (step S6).

When a predetermined value is reached by the number of times the incident resolution information has been received from the in-vehicle device 102, the traffic information center 101 judges that the incident is resolved. Alternatively, the judgment of incident resolution may be made in accordance with travel path conditions and velocity difference conditions that are indicated in a resolution information table shown in FIG. 16. The travel path conditions include the distance to a typical path and threshold value therefor. The velocity difference conditions include the information about an average velocity difference and threshold value therefor. The judgment of incident resolution may alternatively be made in accordance with the difference between the distance to a typical path and threshold value and the difference between the average velocity difference and threshold value. After it is judged that the incident is resolved, the information about incident resolution is created and transmitted to the in-vehicle device mounted in a vehicle in an area surrounding the incident site (step S7). On the other hand, if it is judged that the incident is still not resolved, the flow returns to the beginning of the process.

The process performed by the in-vehicle device 102 mounted in each probe car will now be described. The incident resolution condition reception section 204 receives the incident resolution condition that is transmitted from the traffic information center 101 as an incident resolution condition table shown in FIG. 5 (step S8).

Figure 13:
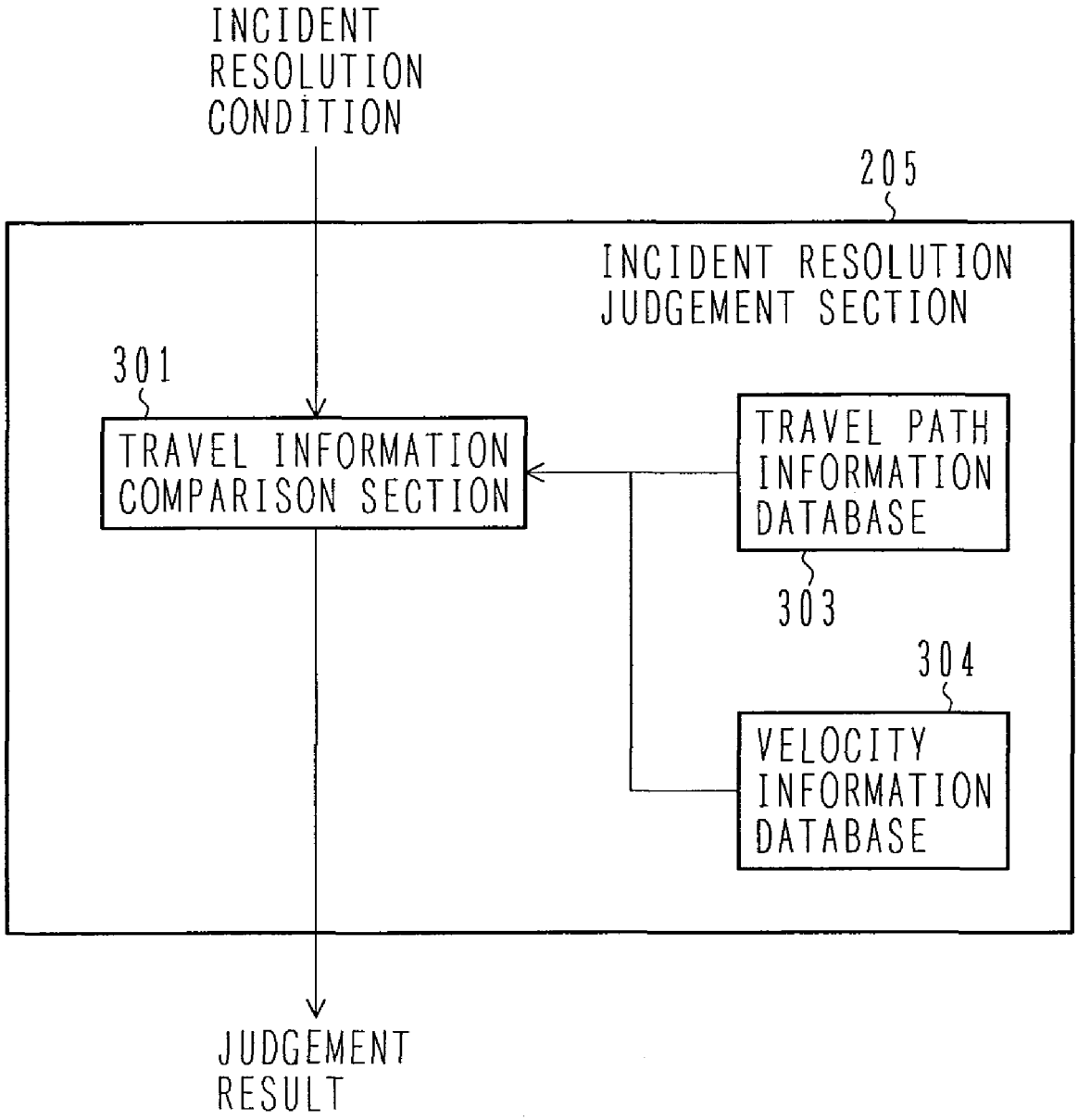
FIG. 13 is a diagram showing a configuration of an incident resolution judgment section.

The incident resolution judgment section 205 compares the position of its vehicle against the positional information about the incident while the probe car is actually running. When the incident site is passed, the incident resolution judgment section 205 judges in accordance with the incident resolution condition whether the incident is present or resolved (step S9). FIG. 13 shows an internal configuration of the incident resolution judgment section 205. The incident resolution judgment section 205 includes a travel information comparison section 301, a travel path information database 303, and a velocity information database 304. The travel path information database 303 and velocity information database 304 store vehicle travel paths and traveling velocities.

Figure 14:
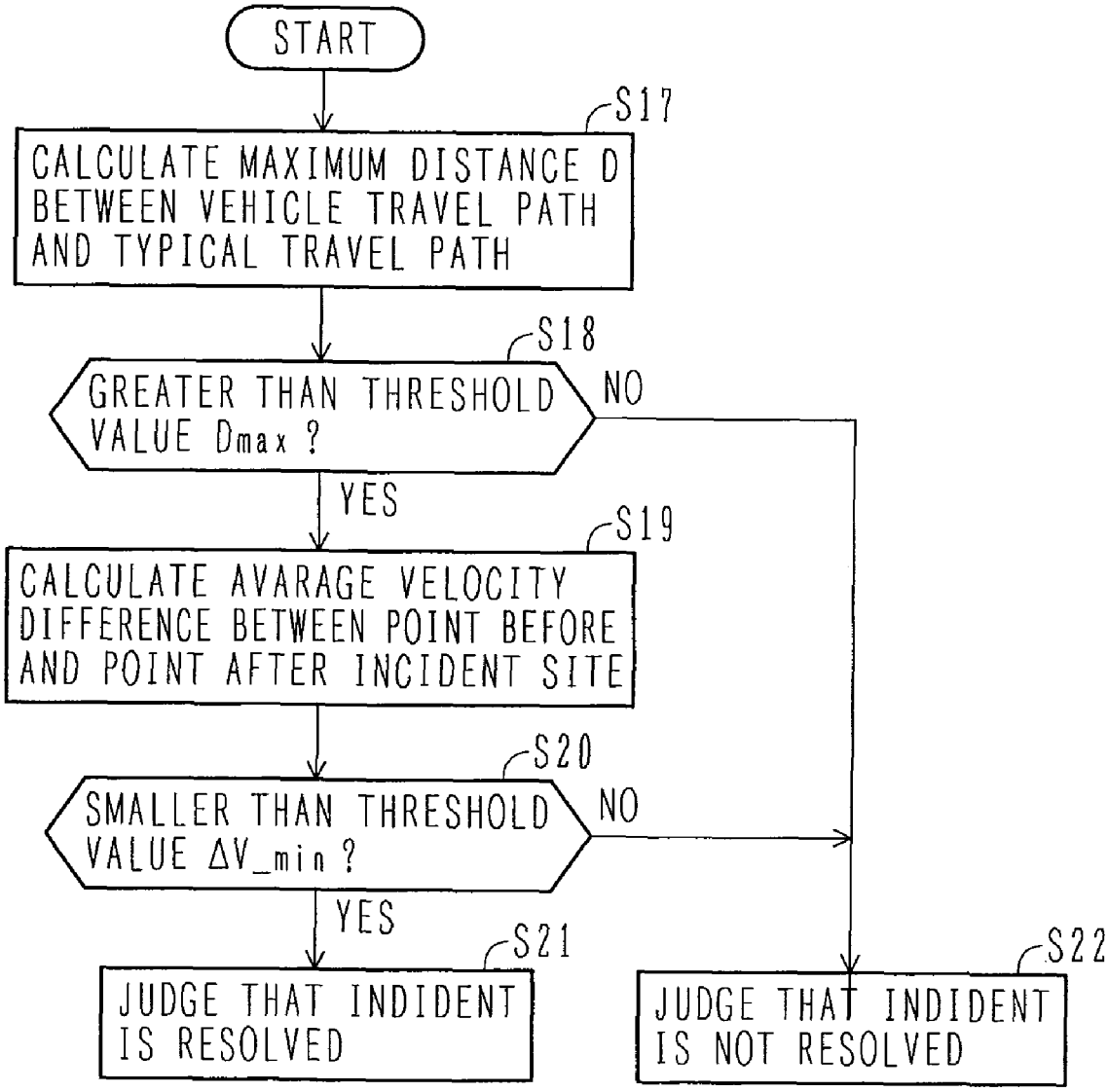
FIG. 14 is a flowchart illustrating an incident resolution judgment process.

The travel information comparison section 301 compares the reference data of the received incident resolution condition and its threshold value against the travel path information about a point before and a point after the incident site, which is extracted from the travel path information database 303, and the average velocity information about the point before and the point after the incident site, which is extracted from the velocity information database 304, as indicated in a flowchart in FIG. 14, and judges whether the incident is resolved.

Figures 15, 16:
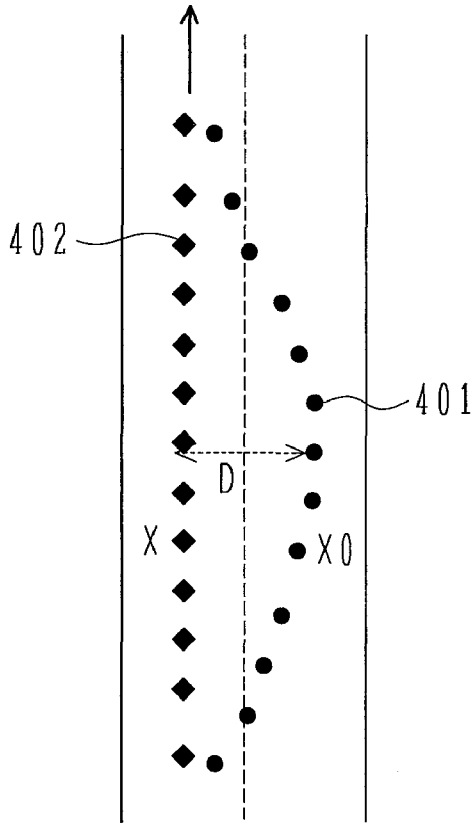
FIG. 15 is a diagram showing a vehicle travel path and a typical path that are sampled over a fixed distance.
FIG. 16 is a diagram showing the structure of incident resolution information to be transmitted from an in-vehicle device.

First of all, the comparison between a typical path and vehicle travel path will be described. FIG. 15 shows a typical path x0(*i*) (401), which is sampled over a fixed distance, and a vehicle travel path x(i) (402), which is extracted from the travel path information database 303. The typical path x0(*i*) is extracted from the received incident resolution condition. The incident resolution judgment conditions are based on a maximum value D of the distance between the typical path x0(*i*) and vehicle travel path x(i) and the threshold value Dmax for the typical path conditions. Therefore, the maximum value D of the distance between the typical path x0(*i*) and vehicle travel path x(i) is calculated from Equation 5 below (step S17). The maximum value D of the distance between the typical path x0(*i*) and vehicle travel path x(i) is compared against the threshold value Dmax to judge whether the incident is resolved (step S18).

$$D=\max |x(i)-x0(i)| \ (i=1 \ldots n) \quad \text{(Equation 5)}$$

If the maximum value D of the distance, which is calculated from Equation 5, is not smaller than the threshold value Dmax, the flow proceeds to step S19 because it is judged that the incident may be resolved. If, on the other hand, the maximum value D of the distance is smaller than the threshold value Dmax, the flow proceeds to step S22 because it is judged that the vehicle travel path is close to the typical travel path. In step S22, it is concluded that the incident is not resolved.

If the road has two or more lanes on one side, a plurality of typical paths for incident passage exist as shown in FIG. 7. When, for instance, the road has two lanes on one side, it is assumed that the typical paths are X0 and Y0. An evaluated value D is determined by calculating the maximum values Dx, Dy of the distance between the probe car travel path x(i) and X0(*i*) and of the distance between the probe car travel path x(i) and Y0(*i*) from Equations 6 to 8 below and selecting the smaller value.

$$Dx=\max |x(i)-X0(i)| \ (i=1 \ldots n) \quad \text{(Equation 6)}$$

$$Dy=\max |x(i)-Y0(i)| \ (i=1 \ldots n) \quad \text{(Equation 7)}$$

$$D=(Dx,Dy) \quad \text{(Equation 8)}$$

When the maximum distance value D, which is obtained from Equation 8, is not smaller than the threshold value Dmax, it is judged that the incident may be resolved.

Next, the average velocity difference between a point before and a point after the incident site is used to judge whether the incident is resolved. For this purpose, the average probe car velocities V_before, V_after prevailing before and after the incident site are extracted from the velocity information database 304 shown in FIG. 13 to calculate the average velocity difference (step S19). The difference between V_before and V_after, which is determined in step S19, is then compared against the average velocity difference threshold value Δv_min for the point before and the point after the incident site, which is transmitted from the traffic information center 101.

$$\Delta v_min \geqq V_after - V_before \quad \text{(Equation 9)}$$

If Equation 9 is satisfied, it is judged that vehicles are smoothly running because the average velocity difference between the point before and the point after the incident site is small. Then, the flow proceeds to step S21. In step S21, it is judged that the incident is resolved. If, on the other hand, Equation 9 is not satisfied, the flow proceeds to step S22 because it is judged that traffic is still slow before and after the incident site.

When the judgment result produced by the incident resolution judgment section 205 indicates that the incident is resolved, the incident resolution information transmission section 206 transmits incident resolution information to the traffic information center 101 (step S10). As indicated by the table shown in FIG. 16, the incident resolution information includes the information about the distance to the typical path and its threshold value and the average velocity difference and its threshold value. When, on the other hand, it is judged that the incident is not resolved, the incident resolution information transmission section 206 does not transmit the incident resolution information.

This incident resolution information may be simplified so that it is "1" when the incident is judged to be resolved or "0" when the incident is judged to be unresolved.

Since the present embodiment is configured as described above, the traffic information center creates the incident resolution condition for an incident from the information about the incident, and distributes the created incident resolution condition to the probe car. Thus, the probe car uses the incident resolution information transmission section 206 to transmit incident resolution information only when the incident is judged to be resolved. This decreases the number of times the traffic information center 101 receives information such as the travel paths relevant to the incident from the in-vehicle device. As a result, the amount of communication data decreases to reduce the processing load on the traffic information center when compared to the conventional technology that constantly transmits detailed travel history information.

Second Embodiment

A second embodiment will now be described. The second embodiment is obtained by modifying some elements of the first embodiment shown in FIG. 3. More specifically, the second embodiment includes an incident resolution condition creation section 309 and an incident resolution judgment section 310 in place of the incident resolution condition creation section 202 and the incident resolution judgment section 205. The incident resolution condition creation section 309 incorporates a function for adding a validity period to an incident resolution condition and a function for considering future traffic information predicted from statistical traffic information data in addition to the functions of the incident resolution condition creation section 202. The incident resolution judgment section 310 judges in accordance with the incident resolution conditions created by the incident resolution condition creation section 309 whether an incident is resolved.

Figure 17:
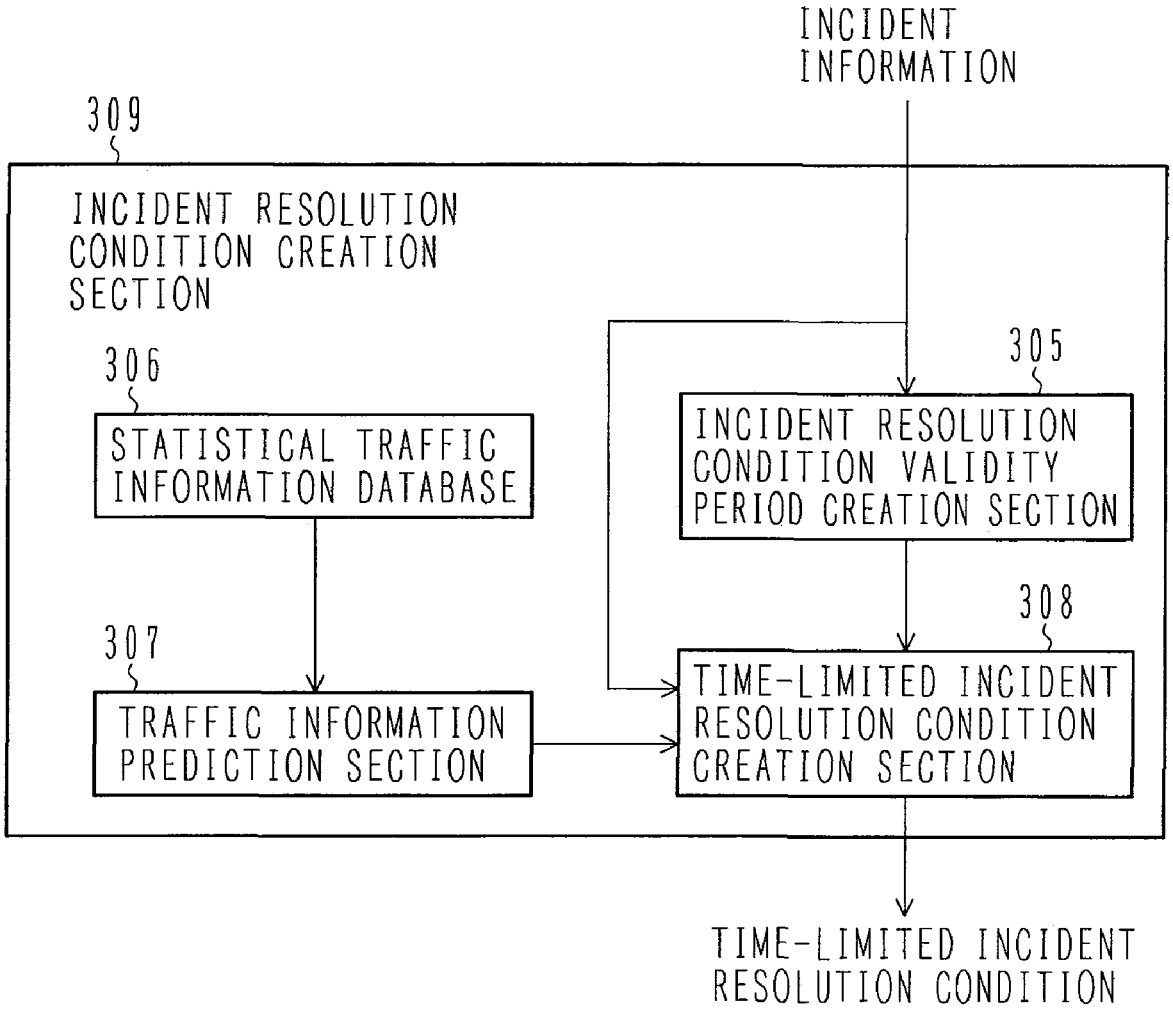
FIG. 17 is a diagram showing an alternative configuration of an incident resolution condition creation section.
Figure 18:
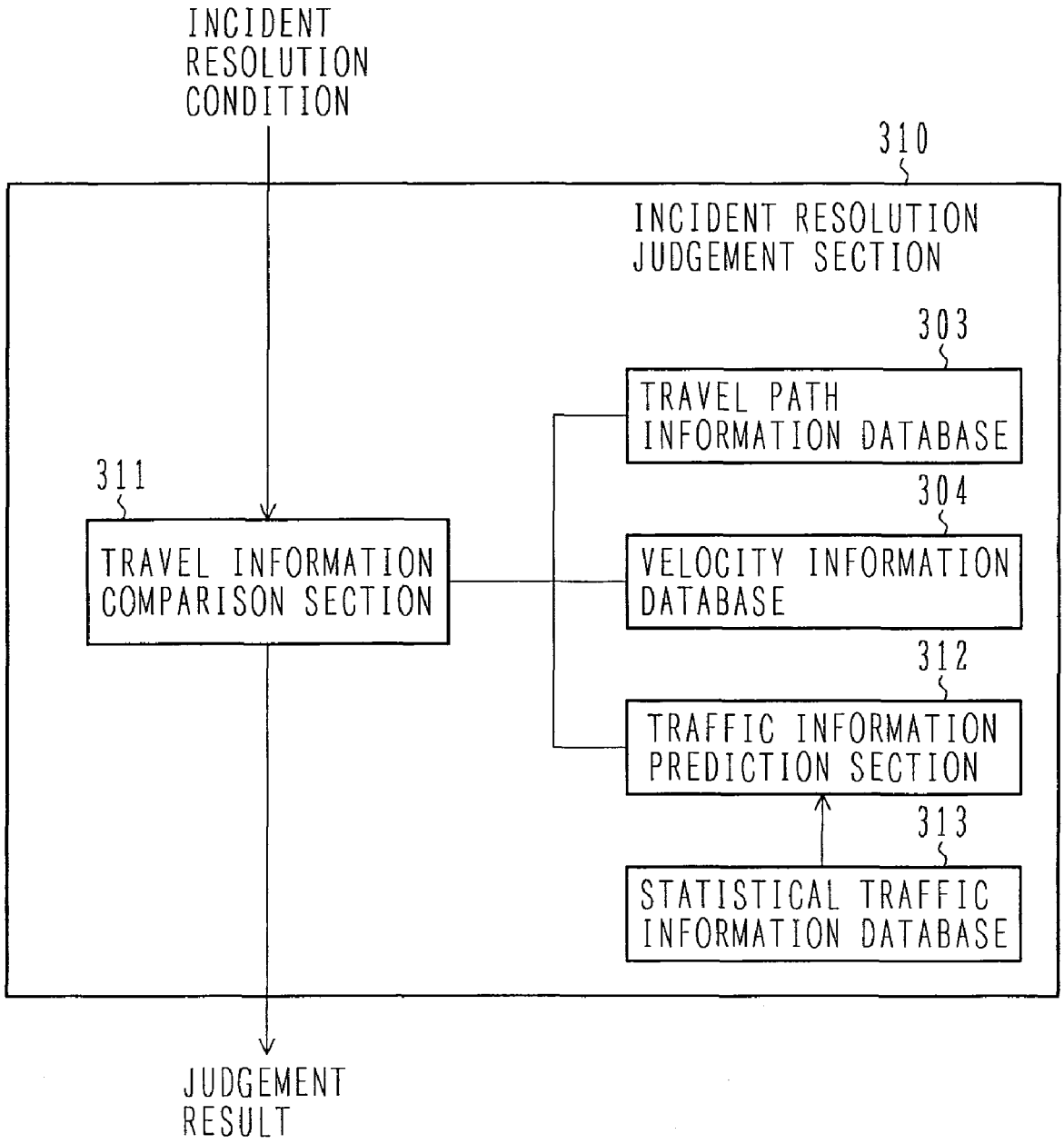
FIG. 18 is a diagram showing an alternative configuration of the incident resolution judgment section.

FIG. 17 shows an internal configuration of the incident resolution condition creation section 309, which includes an incident resolution condition validity period creation section 305, a statistical traffic information database 306, a traffic information prediction section 307, and a time-limited incident resolution condition creation section 308.

The incident resolution condition validity period creation section 305 sets a validity period, for instance, of one hour or one day for an incident resolution condition. When started up, the in-vehicle device 102 checks the validity period and deletes any expired incident resolution information. If, before the receipt of incident resolution information from the traffic information center 101, the driver turns off the in-vehicle device 102 in a situation where an incident resolution condition was received, the use of the validity period makes it possible to prevent the incident resolution condition from being left in the in-vehicle device 102 before completion of incident resolution information reception.

The statistical traffic information database 306 is a collection of statistical traffic information that is obtained by performing a statistical process on past traffic information. The traffic information prediction section 307 uses the statistical traffic information database 306 to predict future traffic information about portions of a road before and after an incident site.

The time-limited incident resolution condition creation section 308 creates incident resolution information while considering the incident resolution information validity period set by the incident resolution condition validity period creation section 305, the prediction result produced by the traffic information prediction section 307, and incident information. The average velocities V_before, V_after prevailing before and after incident site passage, which are derived from the incident information, are created from the average velocity information in the incident information table shown in FIG. 4. These average velocities prevailing before and after an incident site are determined from the incident information that was transmitted from a probe car immediately after the occurrence of an incident. Therefore, they can be regarded as the average velocities prevailing at the time of incident occurrence. The result of traffic information prediction is considered together with the average velocities prevailing before and after the incident site. The traffic information prediction section 307 assumes that a predicted average velocity prevailing at a road link before the incident site at time tn is F_before (tn), and that a predicted average velocity prevailing at a road link after the incident site at time tn is F_after(tn). It is assumed that the time of incident occurrence is t0. Predicted average velocities prevailing when time t elapses after incident occurrence F_before(t0+t), F_after(t0+t) are used to determine a net velocity difference with statistical influence excluded. The net velocity difference is used to create a threshold value for the typical path conditions. The velocity difference threshold value Δv_min calculated from Equation 3 or 4, which were described in conjunction with the first embodiment, is statistically adjusted to obtain a new velocity difference threshold value Δv'_min as indicated by Equation 10.

$$\Delta v'_min = \Delta v_min - (F_after(t0) - F_before(t0)) \quad \text{(Equation 10)}$$

Meanwhile, the incident resolution judgment section 310 of the in-vehicle device 102 includes, in addition to the elements of the incident resolution judgment section 205 according to the first embodiment shown in FIG. 13, a statistical traffic information database 313 and a traffic information prediction section 312, which are the same as the counterparts of the incident resolution condition creation section 309. The statistical traffic information database 313 and traffic information prediction section 312 perform the same functions as the statistical traffic information database 306 and traffic information prediction section 307 of the incident resolution condition creation section 309. Further, when the travel information comparison section 311 judges whether an incident is resolved, it extracts the average probe car velocities V_before, V_after prevailing before and after the incident site from the velocity information database 304 and forms a judgment while statistically adjusting the average velocities. Therefore, the traffic information prediction section 312 determines predicted average velocities F_before(t0+t), F_after(t0+t) prevailing when time t elapses after the time of incident occurrence t0. Eventually, the incident resolution condition indicated by Equation 11 below, instead of Equation 9 which relates to the first embodiment, is used to judge whether the incident is resolved.

$$\Delta v'_min \geqq (V_after - V_before) - (F_after(t0+t) - F_before(t0+t)) \quad \text{(Equation 11)}$$

In the configuration described above, the traffic information center creates an incident resolution condition while considering the incident information and the elapsed time from the occurrence of an incident. Thus, the current situation of the incident and the result of future traffic information prediction are taken into account. As a result, the second embodiment can transmit more accurate incident resolution information than the first embodiment.

What is claimed is:

1. An incident resolution judgment system in which a traffic information center collects travel information about a vehicle in which an in-vehicle device is mounted and judges in accordance with information supplied from the in-vehicle device whether an incident on a road is resolved, wherein the traffic information center includes an incident resolution condition creation section for creating an incident resolution condition about the encountered incident for the in-vehicle device to judge whether the incident is resolved, in accordance with the travel information transmitted from the vehicle that has passed through the site of the incident, and an incident resolution condition transmission section for transmitting the created incident resolution condition to an in-vehicle device near the site of the incident;

wherein the in-vehicle device includes a reception section for receiving the incident resolution condition from the traffic information center, an incident resolution judgment section for judging whether the incident is resolved, in accordance with the received incident resolution condition and the travel information about a vehicle in which the in-vehicle device is mounted, and a transmission section for transmitting incident resolution information to the traffic information center when the incident resolution judgment section has judged that the incident related to the received incident resolution condition is resolved; and wherein the traffic information center judges whether the incident is resolved, in accordance with the incident resolution information received from the in-vehicle device.

2. The incident resolution judgment system according to claim 1, wherein the incident resolution condition creation section determines a typical travel path for passing a site of the incident from a travel path record included in travel information transmitted from a vehicle that passed the site of the incident after the occurrence of the incident, and creates a threshold value for a difference between the typical travel path and a travel path of a vehicle passing the site of the incident as the incident resolution condition.

3. The incident resolution judgment system according to claim 1, wherein the incident resolution condition creation section determines an average vehicle velocity difference between a point before and a point after a site of the incident from a travel velocity record included in travel information transmitted from a vehicle that passed the site of the incident after the occurrence of the incident, and creates the incident resolution condition that includes the determined average vehicle velocity difference and a threshold value for an average vehicle velocity difference between a point before and a point after the site of the incident.

4. The incident resolution judgment system according to claim 3, wherein the threshold value is created in accordance with an average velocity difference between a point before and a point after the site of the incident, which is predicted in accordance with past traffic information data.

5. The incident resolution judgment system according to claim 1, wherein the incident resolution condition creation section adds a validity period to the incident resolution condition in accordance with information about the encountered incident.

6. An incident resolution judgment method for causing a traffic information center to collect travel information about a vehicle in which an in-vehicle device is mounted and to judge in accordance with information supplied from the in-vehicle device whether an incident on a road is resolved, the incident resolution judgment method comprising the steps of:

causing the traffic information center to create an incident resolution condition about an encountered incident for the in-vehicle device to judge whether the incident is resolved, in accordance with the travel information transmitted from the vehicle that has passed through the site of the incident, and to transmit the created incident resolution condition to an in-vehicle device near the site of the incident;

causing the in-vehicle device to receive the incident resolution condition from the traffic information center, and to judge whether the incident is resolved, in accordance with the received incident resolution condition and the travel information about a vehicle in which the in-vehicle device is mounted, and to transmit incident resolution information to the traffic information center when the incident related to the received incident resolution condition is judged to be resolved; and causing the traffic information center to judge whether the incident is resolved, in accordance with the incident resolution information received from the in-vehicle device.

7. The incident resolution judgment method according to claim 6, wherein the step of creating the incident resolution condition includes the step of determining an average vehicle velocity difference between a point before and a point after a site of the incident from a travel velocity record included in travel information transmitted from a vehicle that passed the site of the incident, and step of creating the incident resolution condition that includes the determined average vehicle velocity difference and a threshold value determined according to an average vehicle velocity difference between a point before and a point after the site of the incident that is predicted in accordance with past traffic information data;

wherein the step of causing the in-vehicle device to judge whether the incident is resolved includes the step of judging whether the incident is resolved, in accordance with the threshold value for the average vehicle velocity difference included in the received incident resolution condition and an average velocity difference of a vehicle in which the in-vehicle device is mounted between a point before and a point after the site of the incident, and step of transmitting the incident resolution information to the traffic information center when the incident is judged to be resolved.

* * * * *